US011248366B1

(12) United States Patent
Sulosky

(10) Patent No.: US 11,248,366 B1
(45) Date of Patent: Feb. 15, 2022

(54) HOLDER BLOCK ASSEMBLY WITH MECHANICAL EXTRACTION DEVICE

(71) Applicant: William P. Sulosky, Davidsville, PA (US)

(72) Inventor: William P. Sulosky, Davidsville, PA (US)

( * ) Notice: Subject to any disclaimer, the term of this patent is extended or adjusted under 35 U.S.C. 154(b) by 430 days.

(21) Appl. No.: 16/435,943

(22) Filed: Jun. 10, 2019

Related U.S. Application Data

(60) Provisional application No. 62/686,351, filed on Jun. 18, 2018.

(51) Int. Cl.
*E02F 9/28* (2006.01)
*E21C 35/197* (2006.01)
*E21C 35/18* (2006.01)

(52) U.S. Cl.
CPC ..... *E02F 9/2816* (2013.01); *E21C 35/188* (2020.05); *E21C 35/197* (2013.01); *E02F 9/2858* (2013.01)

(58) Field of Classification Search
CPC ..... E02F 9/2816; E02F 9/2858; E02F 9/2891; E02F 9/28; E02F 9/2876; E02F 9/2875; E02F 9/2825; E02F 9/2866; E21C 35/1831; E21C 35/188; E21C 35/197; E21C 35/19; E21C 35/191
See application file for complete search history.

(56) References Cited

U.S. PATENT DOCUMENTS 3,512,838 A * 5/1970 Kniff ..... E21C 35/19 299/104
3,659,654 A * 5/1972 Davies ..... E02F 9/2875 172/699
5,098,167 A * 3/1992 Latham ..... E21C 35/197 299/104
5,842,747 A * 12/1998 Winchester ..... E01C 23/088 299/87.1
6,357,832 B1 * 3/2002 Sollami ..... E21C 35/183 299/104
6,371,567 B1 * 4/2002 Sollami ..... B28D 1/188 299/104
7,832,808 B2 * 11/2010 Hall ..... E21C 35/197 299/104
7,891,084 B1 * 2/2011 Sollami ..... E02F 9/2891 29/760
8,020,941 B2 * 9/2011 Latham ..... E21C 35/19 299/104
8,201,893 B1 * 6/2012 Sollami ..... B23B 31/06 299/102
8,638,148 B2 1/2014 Sulosky
2002/0070602 A1 * 6/2002 Sollami ..... E21C 35/183 299/104

(Continued)

FOREIGN PATENT DOCUMENTS

DE 19611455 A1 * 9/1996 ..... E21C 35/197
EP 2754854 A1 * 7/2014 ..... E21C 35/197

*Primary Examiner* — Adam J Behrens
(74) *Attorney, Agent, or Firm* — Hooker & Habib, P.C.

(57) ABSTRACT

A holder block assembly for a drum-type cutting tool has a holder block and a sleeve that is removably held in the holder block to carry a cutter bit. The sleeve includes a shank received in a hole in a cutter block and a nut threaded on the shank. The nut is turned by a hand tool to extract the sleeve from the holder block.

12 Claims, 6 Drawing Sheets

(56) References Cited

U.S. PATENT DOCUMENTS

| | | | | |
|---|---|---|---|---|
| 2008/0036277 | A1* | 2/2008 | Hall | E21C 35/183 299/104 |
| 2008/0067859 | A1* | 3/2008 | Hall | E21C 35/183 299/102 |
| 2008/0088172 | A1* | 4/2008 | Hall | E21C 35/1933 299/39.8 |
| 2010/0148568 | A1* | 6/2010 | Latham | E21C 35/19 299/111 |
| 2012/0223568 | A1* | 9/2012 | Sulosky | E21C 35/197 299/29 |
| 2012/0311853 | A1* | 12/2012 | Parrott | E21C 35/197 29/700 |
| 2014/0191563 | A1* | 7/2014 | Elfgen | E21C 35/183 299/104 |
| 2014/0263787 | A1* | 9/2014 | Harney | B02C 4/30 241/185.5 |
| 2021/0003007 | A1* | 1/2021 | Beard | E21C 35/197 |

* cited by examiner

HOLDER BLOCK ASSEMBLY WITH MECHANICAL EXTRACTION DEVICE

RELATED APPLICATION

This application claims the benefit of and priority to my U.S. Patent Application Ser. No. 62/686,351 "Holder Block Assembly with Mechanical Extraction Device" filed Jun. 18, 2018, which priority application is incorporated by reference as if fully set forth herein.

FIELD OF THE DISCLOSURE

This disclosure relates to cutting tools used with drum-type cutters and the like, and in particular to a cutting tool having a cutter bit held in a sleeve, the sleeve removably held in a holder block.

BACKGROUND OF THE DISCLOSURE

My U.S. Pat. No. 8,638,148 (incorporated by reference as if fully set forth herein) discloses a holder block assembly.

The holder block assembly includes a sleeve that removably holds a cutter bit, and a holder block that removably holds the sleeve. The sleeve is received in a hole defined by a hole wall of the holder block. The wall includes a number of axially adjacent surface sections that each have an axial length and become successively smaller in cross-section in the direction the sleeve is inserted into the holder block.

The sleeve includes an enlarged flange and a shank extending from the flange. The shank includes a number of axially adjacent surface sections that each have an axial length and become successively smaller in cross-section in a direction away from the flange. When the sleeve is fully received in the holder block, cooperating pairs of holder block and shank cross sections define multiple interference fits between them that retain the sleeve in the holder block.

The holder block carries a tubular piston that is located immediately beneath the sleeve flange and surrounds the sleeve shank when the sleeve is held by the holder block. The tubular piston is urged upwardly by hydraulic pressure and urges the sleeve away from the holder block with sufficient force to overcome the interference fits and displace the sleeve relative to the holder block. The sleeve only has to displace the axial length of the cooperating pairs of surface sections for the sleeve shank to release from the holder block.

The hydraulic extraction system disclosed in the '148 patent works well. There is a need however for a holder block assembly for a cutting tool that does not utilize hydraulic fluid while offering the other advantages of my holder block assembly.

SUMMARY OF THE DISCLOSURE

Disclosed is a holder block assembly for a cutting tool utilizing a mechanical extraction system for extracting a sleeve from a holder block.

The holder block assembly in an embodiment includes a sleeve for removably holding a cutter bit and a holder block for removably holding the sleeve. The sleeve has an enlarged flange and a shank extending away the flange. A tapered portion of the shank and the holder block have cooperating surface sections that define multiple interference fits that retain the sleeve in the holder block.

The mechanical extraction system includes an externally threaded portion of the shank sleeve disposed between the flange and the tapered shank portion. A nut is threaded onto the threaded shank portion before the sleeve is driven into the hole of the holder block. The nut is tightened against a radially enlarged portion of the shank that prevents further movement of the nut towards the flange. In possible embodiments this radially enlarged portion of the shank is the flange itself.

The nut is larger than the holder block hole receiving the shank. When the nut is fully threaded onto the shank the nut abuts the surface of the holder block, limiting the insertion depth of the shank into the holder block, and thereby axially positioning the shank in the holder block at the correct orientation for proper interference fit between the shank and thee holder block.

The nut is sandwiched between the holder block and the enlarged portion of radially enlarged portion of the sleeve when the sleeve is held by the holder block.

To extract the sleeve from the holder block, the nut is rotated by applying torque to the nut so that the cooperating threads of the nut and shank urge the nut towards the holder block. The applied torque generates an axial force urging the sleeve away from the holder block with sufficient force to overcome the interference fits between the shank and the holder block. Continued rotation of the nut displaces the sleeve axially away from the holder block. The nut has to rotate only enough for the sleeve to displace relative to the holder block the axial length of the pairs of cooperating surface sections as previously described to release the sleeve from the holder block.

The nut in embodiments is designed to cooperate with a wrench specifically designed to engage the nut and apply torque to the nut. The nut may include a number of circumferentially spaced blind holes that receive lugs of the wrench.

The disclosed holder block assembly enables extraction of the sleeve from the cutter block utilizing a simple hand tool, does not require a source of compressed air or hydraulic fluid, and can be accomplished on site without hose lines.

Other objects and features of the disclosed holder block assembly will become apparent as the description proceeds, especially when taken in conjunction with the accompanying drawing sheets illustrating one or more non-limiting embodiments.

DETAILED DESCRIPTION

Figure 1:
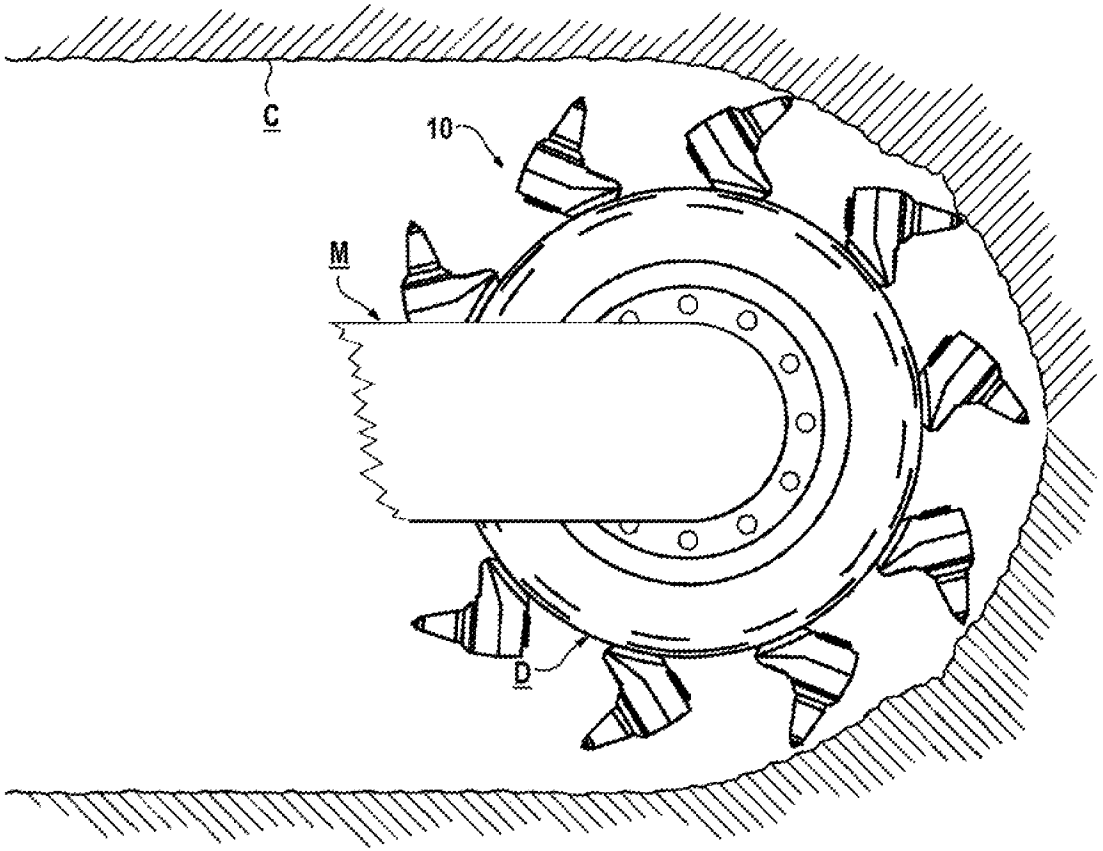
FIG. 1 is a depiction of an earth working operation including a drum with holder block assemblies in accordance with this disclosure attached to a support of a mining machine.

FIG. 1 illustrates a number of like holder block assemblies 10 in accordance with this disclosure mounted on the outer periphery of a cutting drum D of a mining machine M used in coal mining. The cutting drum rotates to impact cutter bits carried by the holder block assemblies against a coal seam or earthen material C.

Figure 2:
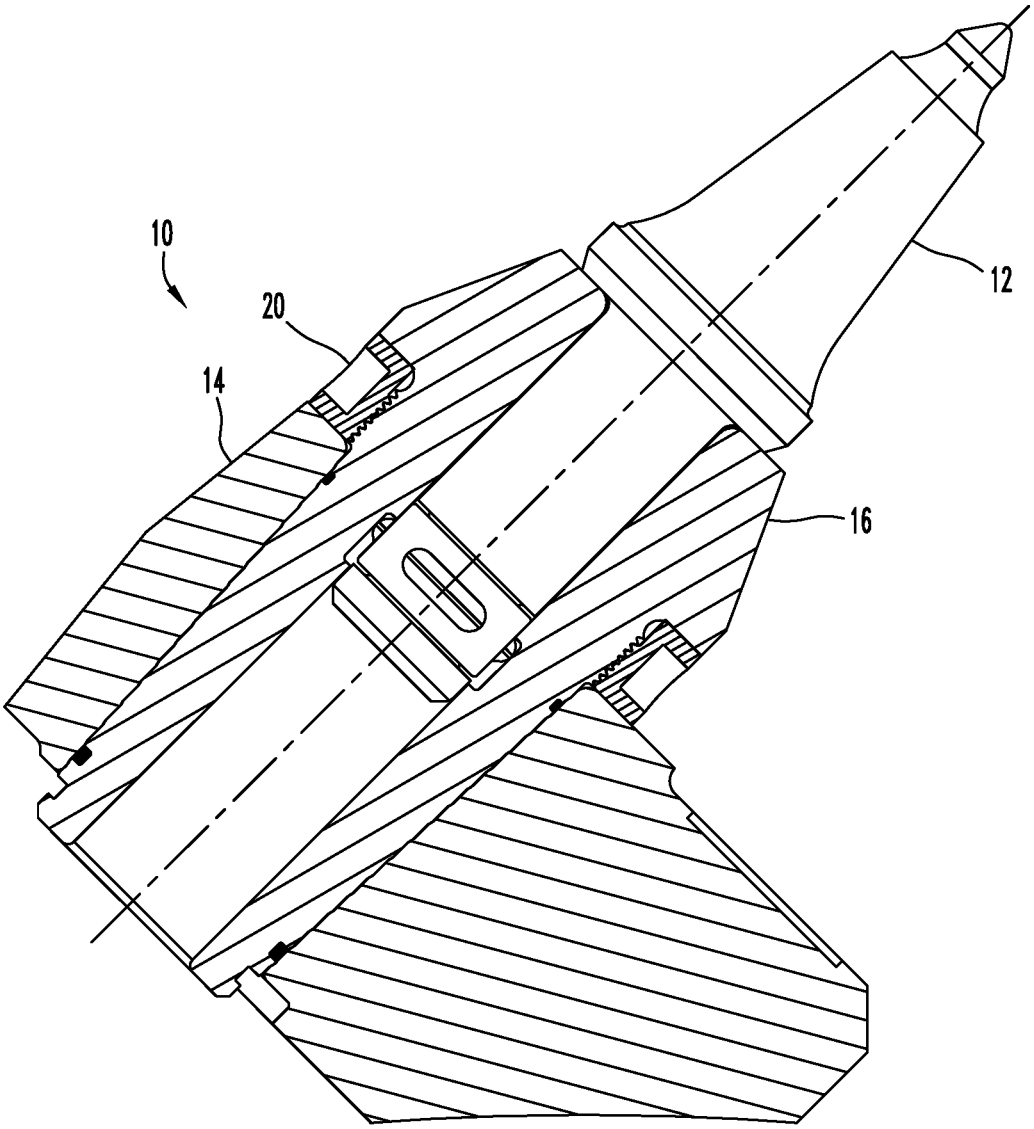
FIG. 2 is a vertical sectional view of a holder block assembly shown in FIG. 1.

FIG. 2 is a sectional view of one of the holder block assemblies 10. The holder block assembly is shown carrying a conventional cutter bit 12. The holder block assembly includes a holder block 14 that mounts the assembly to the drum D and removably carries a sleeve 16. The sleeve removably carries the cutter bit 12. The holder block assembly includes a mechanical extraction system in which a nut 20 threaded on the sleeve, the nut enabling removal of the sleeve from the holder block using a simple hand tool as explained in more detail below.

Figure 3:
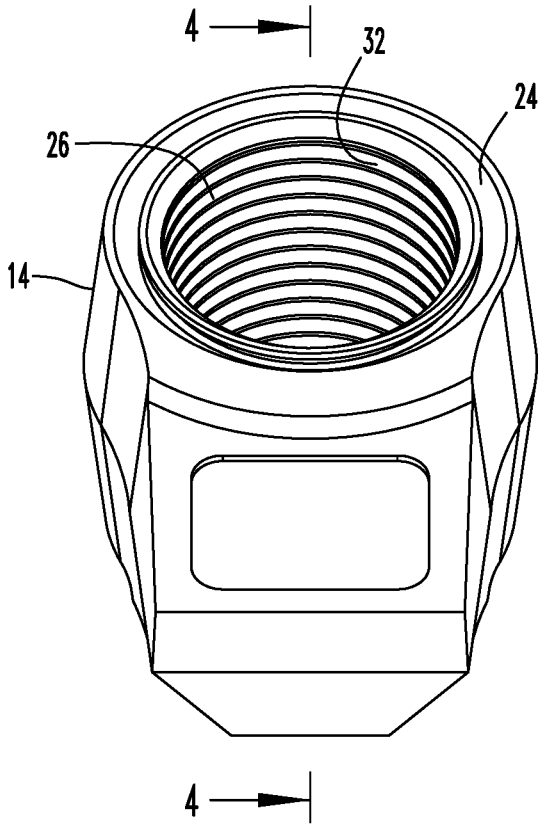
FIG. 3 is a front view of the holder block of the holder block assembly shown in FIG. 2.
Figure 4:
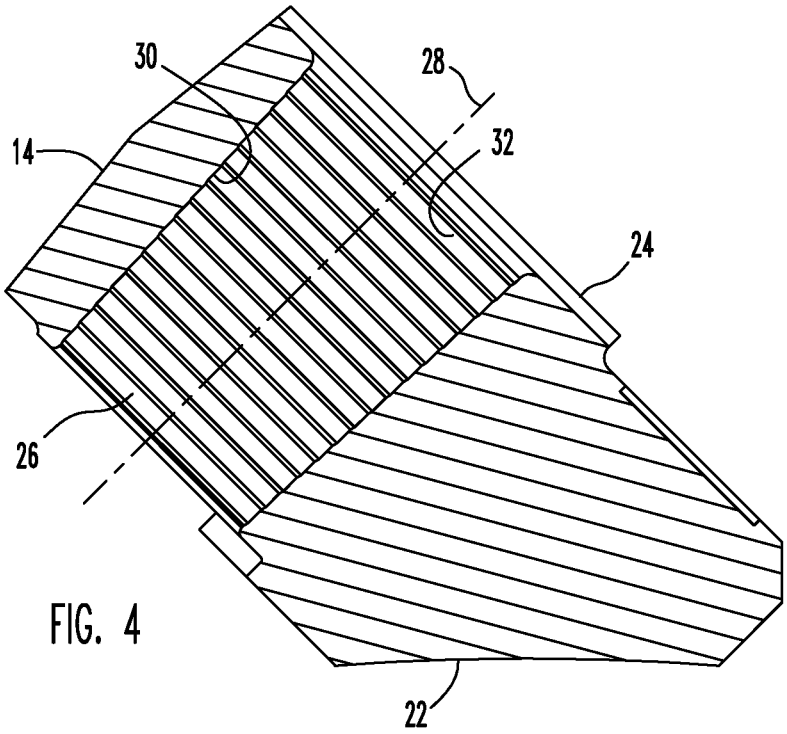
FIG. 4 is a sectional view of the sleeve shown in FIG. 3 taken along line 4-4 of FIG. 3.

The holder block 14 is illustrated in FIGS. 3 and 4. The holder block has a curved lower wall surface 22 that mounts the holder block to the cutting drum D. A flat outer peripheral wall surface 24 faces towards the intended cutting direction of the cutter bit. A through hole 26 extends from the outer surface 24 and into the holder block along an axis 28 that is perpendicular to the outer surface. The through hole is defined by an annular hole wall 30. The hole wall includes a number of axially adjacent, circular surface sections 32 that have a common axial length and become successively smaller in diameter in a direction extending axially away from the outer wall surface 24.

Figure 6:
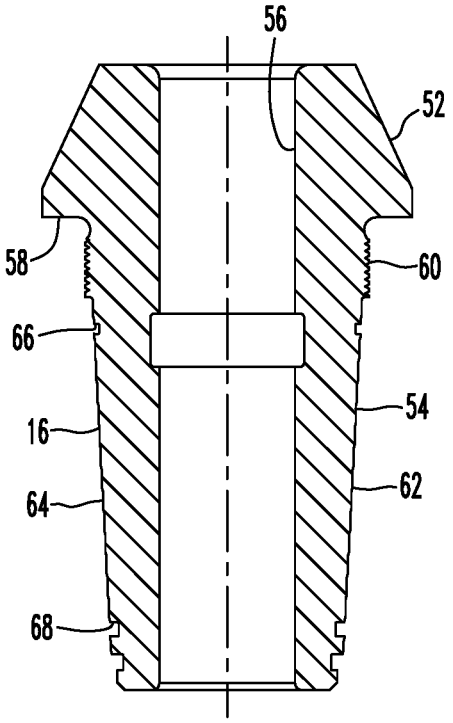
FIG. 6 is a vertical sectional view of the sleeve shown in FIG. 5.
Figure 5:
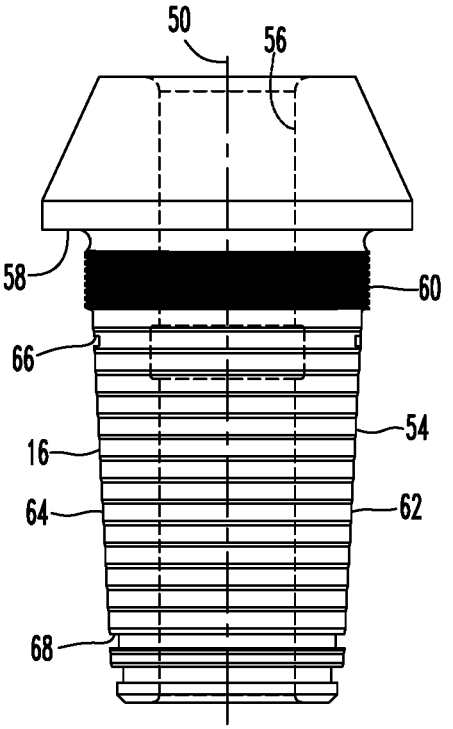
FIG. 5 is a front view of the sleeve of the holder block assembly shown in FIG. 2.

The sleeve 16 is illustrated in FIGS. 5 and 6. The sleeve extends along a central axis 50. An enlarged head or flange 52 is located on one end of the sleeve. A reduced-diameter shank 54 extends axially from the flange to an opposite end of the sleeve. A central through-hole 56 extends the length of the sleeve and is sized to receive the cutter bit 12.

The flange 52 has a generally flat rear shoulder or rear surface 58 surrounding the shank 54 that is perpendicular to the axis 50. The rear surface faces towards the opposite end of the sleeve.

The shank 54 includes an externally threaded, circular shank portion 60 adjacent to the flange 52 and a tapered shank portion 62 extending away from the threaded shank portion to the opposite end of the sleeve. The shank may also include a stress relief undercut located between the flange and the threaded shank portion.

The tapered shank portion 62 includes a number of axially adjacent, circular outer surface sections 64. The outer circular sections 64 have a common axial length and become successively smaller in diameter in a direction extending axially away from flange 52.

The tapered shank portion 62 also includes a first O-ring groove 66 adjacent to the threaded shank portion 60 and a second O-ring groove 68 adjacent to the other end of the sleeve 16. The O-ring grooves receive O-rings that form seals between the sleeve and the holder block 14 when the sleeve is received in the holder block.

Figure 8:
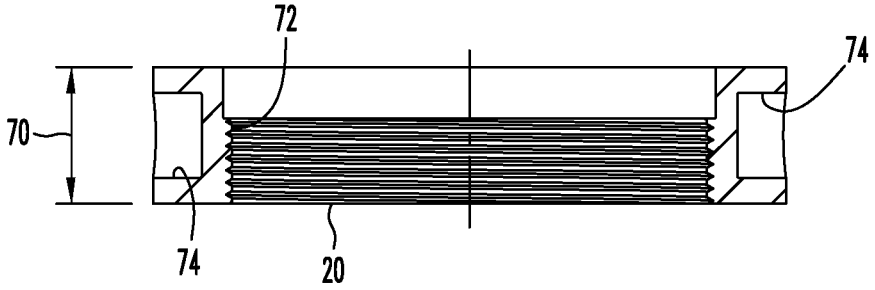
FIG. 8 is a sectional view of the nut shown in FIG. 7 taken along line 8-8 of FIG. 7.
Figure 7:
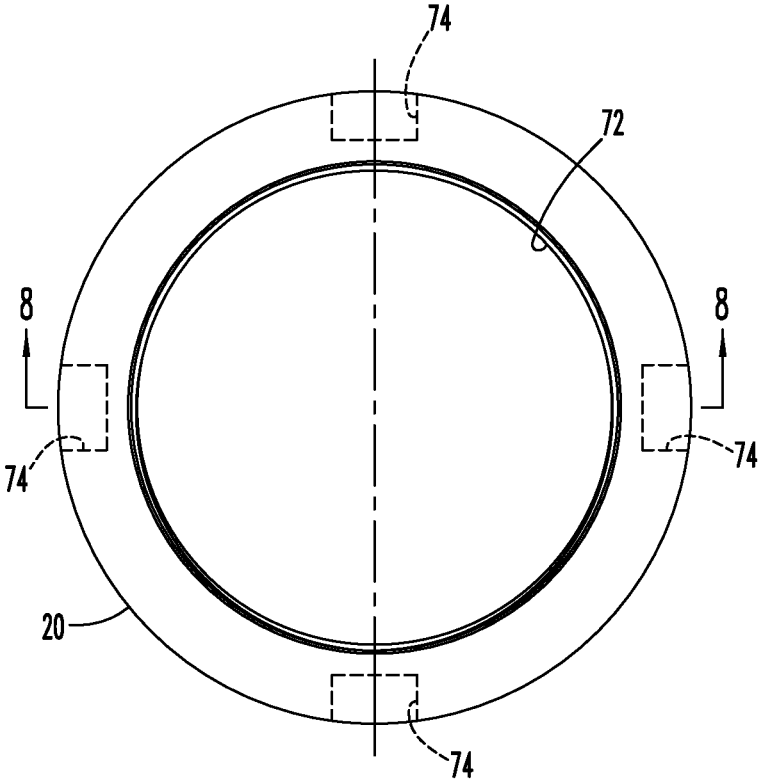
FIG. 7 is a top view of the nut of the holder block assembly shown in FIG. 2.

The nut 20 is illustrated in FIGS. 7 and 8. The nut is a generally circularly cylindrical metal body having a length dimension 70 and an internally threaded through bore 72. The internal threads of the nut are sized to be threadable with the external threads of the sleeve 16. The nut can receive the tapered shank portion 54 of the sleeve to enable the nut to be threadably attached to the sleeve as shown in FIG. 2.

Equally spaced around the outer periphery of the nut 20 are four like blind holes 74. The blind holes are used in cooperation with a spanner wrench described below to apply torque to the nut. In other embodiments the nut can be configured as a hex nut intended to be used with an open end wrench.

Figure 9:
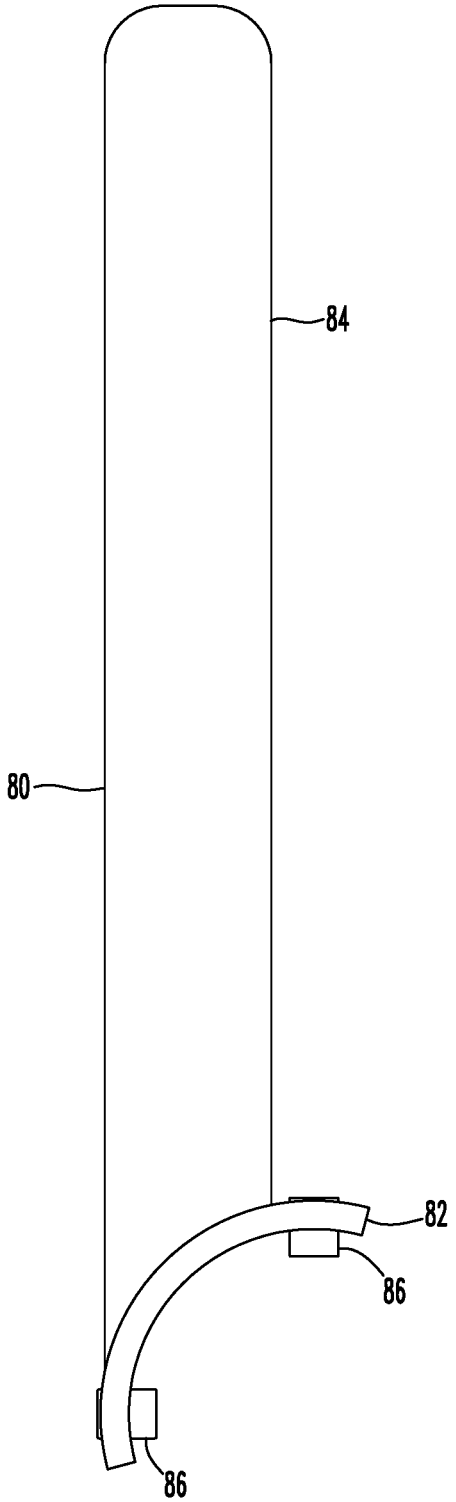
FIGS. 9 and 10 are front and side views respectively of a spanner wrench for applying torque to the nut shown in FIG. 7.
Figure 10:
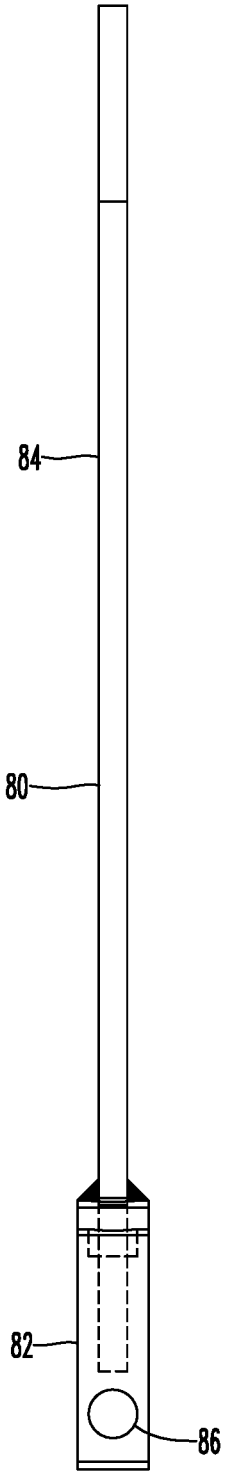

FIGS. 9 and 10 illustrate a spanner wrench 80 for turning the nut 20. The wrench includes an open end 82 that receives the nut and an elongate handle 84 extending from the open end. A pair of pins or lugs 86 extends from the open end. The pins are spaced 90 degrees from one another and are received in respective blind holes 74 of the nut to form a non-rotatable connection between the wrench and the nut.

FIG. 2 illustrates the sleeve 16 being held by the holder block 14. The nut 20 is threaded onto the sleeve shank threaded portion 60 and tightened against the flange surface 58 before the shank 54 is driven into the holder block hole 26. My '148 patent describes driving the sleeve shank into the holder block to form interference fits between corresponding surfaces 64, 30 of the sleeve shank and holder block, and so insertion of the sleeve into the holder block will not be discussed in detail herein.

The nut 20 is larger than the holder block hole and so the nut is sandwiched between the sleeve flange and the holder block when the sleeve shank is fully received into the holder block. The length dimension 70 of the nut establishes the maximum depth of insertion of the sleeve shank into the holder block to form the interference fits between the shank and the holder block when the sleeve shank is fully driven into the holder block.

The nut 20 and the threaded shank portion 60 cooperatively form a mechanical extraction system that enables mechanical extraction of the sleeve from the holder block.

To extract the sleeve from the holder block, the nut 20 is rotated by applying torque to the nut so that the cooperating threads of the nut and shank sleeve urge the nut towards the holder block 14. The applied torque generates an axial force urging the sleeve away from the holder block with sufficient force to overcome the resistance to axial movement of the sleeve shank relative to the holder block generated by the interference fits between the sleeve shank and the holder block. Rotation of the nut displaces the sleeve axially away from the holder block. The nut has to rotate only enough for the sleeve to displace relative to the holder block the axial length of a surface section as previously described for the sleeve shank to be free of the holder block.

While one or more embodiments have been disclosed and described in detail, it is understood that this is capable of modification and that the scope of the disclosure is not limited to the precise details set forth but includes modifications obvious to a person of ordinary skill in possession of this disclosure, including (but not limited to) changes in material selection, size, shape, or configuration and also such changes and alterations as fall within the purview of the following claims.

What is claimed is:

1. A holder block assembly for holding a cutter bit, the holder block assembly comprising:

a holder block, a sleeve removably holdable in the holder block, and a mechanical extraction system operable to remove the sleeve when held by the holder block from the holder block;

the holder block comprising a hole extending along an axis, and a hole wall surrounding the hole;

the sleeve extending along the axis between opposite first and second ends, the sleeve comprising a hole opening from the first end of the sleeve and a shank disposed at the second end of the sleeve, a first portion of the shank being receivable in the hole of the holder block;

the mechanical extraction system comprising a nut and a second portion of the shank, the second portion of the shank being externally threaded and being disposed between the first end of the sleeve and the first portion of the shank, the nut being threadable on the second portion of the shank to form a threaded connection between the nut and the second portion of the shank, the nut being rotatable about the threaded connection and thereby axially movable along the threaded connection between a first axial position closest to the first end of the sleeve and a second axial position spaced away from the first axial position; and the nut when threaded on the second shank portion and in the first position is abuttable against the holder block and thereby resists further insertion of the shank into the holder block hole when the first shank portion is received in the holder block hole, the holder block wall and the first portion of the shank cooperatively forming a connection therebetween when the first shank portion is inserted into the holder block hole that resists axial displacement of the first shank portion out of the holder block hole.

2. The holder block assembly of claim 1 wherein the sleeve comprises a radially enlarged flange disposed at the first end of the sleeve, the shank extending from the flange to the second end of the sleeve.

3. The holder block assembly of claim 2 wherein the nut abuts the flange when the nut is in the first position.

4. The holder block assembly of claim 1 wherein the connection between the holder block hole wall and the first shank portion comprises at least one interference fit therebetween.

5. The holder block assembly of claim 1 wherein the first portion of the shank tapers inwardly as the first portion of the shank extends towards the second end of the sleeve.

6. The holder block assembly of claim 1 wherein the first portion of the shank and the holder block hole wall each have a forward end and a plurality of axially adjacent surface sections that each have an axial length and become successively smaller in cross-section in a direction away from the forward end, and the connection between the first portion of the shank and the holder block hole wall comprises respective interference fits between facing pairs of surface sections.

7. A cutting drum comprising a plurality of holder block assemblies as defined in claim 1.

8. A mining machine comprising the cutting drum defined in claim 7.

9. A method of extracting a sleeve held in the hole of the holder block assembly of claim 1, the sleeve being configured to hold a cutter bit, the method comprising the steps of:

(a) providing the nut threaded on the sleeve, the nut threadably movable in a first direction towards the holder block whereby the nut would engage the holder block and transmit a force to the sleeve urging the nut away from the holder block and the sleeve out of the holder block hole; and (b) applying a torque to the nut urging the nut against the holder block, the torque generating sufficient force transmitted to the sleeve to move the sleeve away from the holder block; and (c) continuing to apply torque to the nut urging the nut against the holder block until the sleeve moves out of the holder block a sufficient distance to release the sleeve from the holder block.

10. The method of claim 9 wherein the sleeve is held in the holder block by at least one interference fit, and step (b) comprises the step of:

(d) transmitting a sufficient force to the sleeve sufficient to overcome resistance of the at least one interference fit.

11. The method of claim 10 wherein a portion of the sleeve is in the holder block hole when the sleeve is released from the holder block.

12. The method of claim 9 wherein the nut abuts the holder block when the sleeve is retained by the holder block.

* * * * *